US008066487B2

(12) United States Patent
Luo

(10) Patent No.: US 8,066,487 B2
(45) Date of Patent: Nov. 29, 2011

(54) FAN SHAFT SEAT STRUCTURE

(75) Inventor: Wei-Jun Luo, Sinjhuang (TW)

(73) Assignee: Asia Vital Components Co., Ltd., Sinjhuang (TW)

( * ) Notice: Subject to any disclaimer, the term of this patent is extended or adjusted under 35 U.S.C. 154(b) by 399 days.

(21) Appl. No.: 12/471,647

(22) Filed: May 26, 2009

(65) Prior Publication Data

US 2010/0266394 A1 Oct. 21, 2010

(30) Foreign Application Priority Data

Apr. 21, 2009 (TW) ..... 98206647 U

(51) Int. Cl.
*F04D 29/056* (2006.01)

(52) U.S. Cl. ..... 416/174; 416/175; 403/243

(58) Field of Classification Search ..... 416/174–175, 416/5, 225–226, 223; 403/243, 220–228
See application file for complete search history.

(56) References Cited

U.S. PATENT DOCUMENTS 6,146,097 A * 11/2000 Bradt ..... 416/5
2007/0231163 A1 10/2007 Liu

* cited by examiner

*Primary Examiner* — H. Jey Tsai
(74) *Attorney, Agent, or Firm* — C. G. Mersereau; Nikolai & Mersereau, P.A.

(57) ABSTRACT

A fan shaft seat structure including a shaft bushing and a heat dissipation member. The shaft bushing has an open end, a closed end and a, connection section. A receiving space is defined between the open end and the closed end. The connection section extends from the closed end in a direction reverse to the receiving space. The heat dissipation member has a first face and a second face. The first face is flush with a first end of the connection section in contact with the closed end of the shaft bushing. The second face is flush with a second end of the connection section. The shaft bushing is integrally connected with the heat dissipation member to increase heat dissipation area and save working time and manufacturing cost as well as achieve better heat dissipation effect.

13 Claims, 5 Drawing Sheets

FAN SHAFT SEAT STRUCTURE

FIELD OF THE INVENTION

The present invention relates to a fan shaft seat structure including a shaft bushing and a heat dissipation member. The shaft bushing is integrally connected with the heat dissipation member to increase heat dissipation area and save working time and manufacturing cost as well as achieve better heat dissipation effect.

BACKGROUND OF THE INVENTION

Recently, the internal circuits of an integrated circuit (IC) chip have been laid out more and more compactly. Consequently, the chip generates higher and higher heat. When a personal computer works, the compact IC chip such as CPU or graphics chip will generate high heat. In order to keep the IC chip functioning lastingly, it is necessary to maintain the IC chip at an optimal working temperature. In this case, the efficiency of the IC chip will not deteriorate due to rise of temperature and the IC chip is protected from damage. In general, a heat dissipation device is used to directly contact the surface of the electronic component for dissipating the heat generated by the electronic component. Accordingly, it can be ensured that the electronic component works normally with a longer lifetime.

A cooling fan is an inevitable component of a heat dissipation device. The cooling fan serves to quickly carry away the heat from the radiating fin assembly by way of convection.

However, after a long period of operation, the cooling fan itself will generate heat, which may cause malfunction of the cooling fan or even damage of the cooling fan. Therefore, some manufacturers have tried to improve the conventional cooling fans so as to overcome the above problem.

FIGS. 1A and 1B show a conventional cooling fan, which includes a fan propeller 10, a shaft seat mount 13 and a heat dissipation board 15. The shaft seat mount 13 is made of plastic material, including a shaft bushing 131, a base section 132 and multiple fixing arms 133. The fan propeller 10 is rotatably connected with the shaft bushing 131 and has an internal receiving space 1311 for accommodating the shaft 101 of the fan propeller 10. The base section 132 radially extends from the circumference of the bottom end of the shaft bushing 131. First ends of the fixing arms 133 extend from the circumference of the base section 132 in a direction away from the shaft bushing 131. Second ends of the fixing arms 133 are formed with fixing holes 1331. Screws 16 can be passed through the fixing holes 1331 to lock the shaft seat mount 13 with the heat dissipation board 15. An upper face of the heat dissipation board 15 is formed with one or more locking holes 151 in alignment with the fixing holes 1331 of the fixing arms 133 respectively. The screws 16 are respectively passed through the fixing holes 1331 and screwed into the locking holes 151 to securely lock the shaft seat mount 13 on the heat dissipation board 15 with the upper face of the heat dissipation board 15 in contact with a lower face of the shaft seat mount 13.

After a long period of high-speed operation, the fan propeller 10 and the shaft 101 thereof will generate heat, which is spread over the receiving space 1311 of the shaft bushing 131. At this time, the shaft bushing 131 will absorb the heat and slowly conduct the heat to the base section 132. The base section 132 then conducts the heat to the heat dissipation board 15. Accordingly, only the part of the upper face of the heat dissipation board 15 that is not in contact with the shaft seat mount 13 can dissipate the heat. As a result, the heat dissipation area is limited and the heat dissipation effect is poor.

There is another problem existing in the conventional cooling fan. That is, when assembling the cooling fan, the shaft seat mount 13 is placed on the heat dissipation board 15. An operator uses a screwdriver (not shown) to screw the screws 16 into the fixing holes 1331 of the fixing arms 133 and the locking holes 151 of the heat dissipation board 15. After the shaft seat mount 13 is fixed on the heat dissipation board 15. Then the operator applies force onto the fan propeller 10 to move the fan propeller 10 into the receiving space 1311 of the shaft bushing 131, whereby the shaft 101 of the fan propeller is inserted into the receiving space 1311 and connected with the shaft bushing 131. It often takes place that an operator over-force the screws 16 to deform the shaft seat mount 13 and thus affect the verticality of the shaft bushing 131. On the other hand, an operator may under-force the screws 16. Under such circumstance, the screws 16 are apt to loosen to unlock the shaft seat mount 13 or even cause damage of the cooling fan in case the fan propeller 10 detaches from the shaft seat mount 13 and the heat dissipation board 15 in operation. Therefore, it is hard to control the magnitude of the applied force in the assembling process so that the uniformity of the products is poor. In addition, the labor cost and manufacturing cost are increased.

According to the above, the conventional cooling fan has the following defects:

1.The heat dissipation efficiency is poor.
2.The labor cost is increased.
3.The manufacturing cost is increased.
4.The heat dissipation area is limited.
5.The uniformity of the products is poor.

SUMMARY OF THE INVENTION

A primary object of the present invention is to provide a fan shaft seat structure in which the shaft bushing is integrally connected with the heat dissipation member to achieve better heat dissipation effect.

A further object of the present invention is to provide the above fan shaft seat structure, which has larger heat dissipation area.

A still further object of the present invention is to provide the above fan shaft seat structure, which can be quickly manufactured to save working time and reduce manufacturing cost.

A still further object of the present invention is to provide the above fan shaft seat structure, which has better product uniformity.

To achieve the above and other objects, the fan shaft seat structure of the present invention includes a shaft bushing and a heat dissipation member. The shaft bushing has an open end, a closed end and a connection section. A receiving space is defined between the open end and the closed end. The connection section extends from the closed end in a direction reverse to the receiving space. The heat dissipation member is a heat dissipation board having a first face and a second face. The first face is flush with a first end of the connection section in contact with the closed end of the shaft bushing. The second face is flush with a second end of the connection section. The shaft bushing is integrally connected with the heat dissipation member to increase heat dissipation area and save working time and manufacturing cost as well as achieve better heat dissipation effect.

BRIEF DESCRIPTION OF THE DRAWINGS

The structure and the technical means adopted by the present invention to achieve the above and other objects can be best understood by referring to the following detailed description of the preferred embodiment and the accompanying drawings, wherein.

DETAILED DESCRIPTION OF THE PREFERRED EMBODIMENT

Figure 1A:
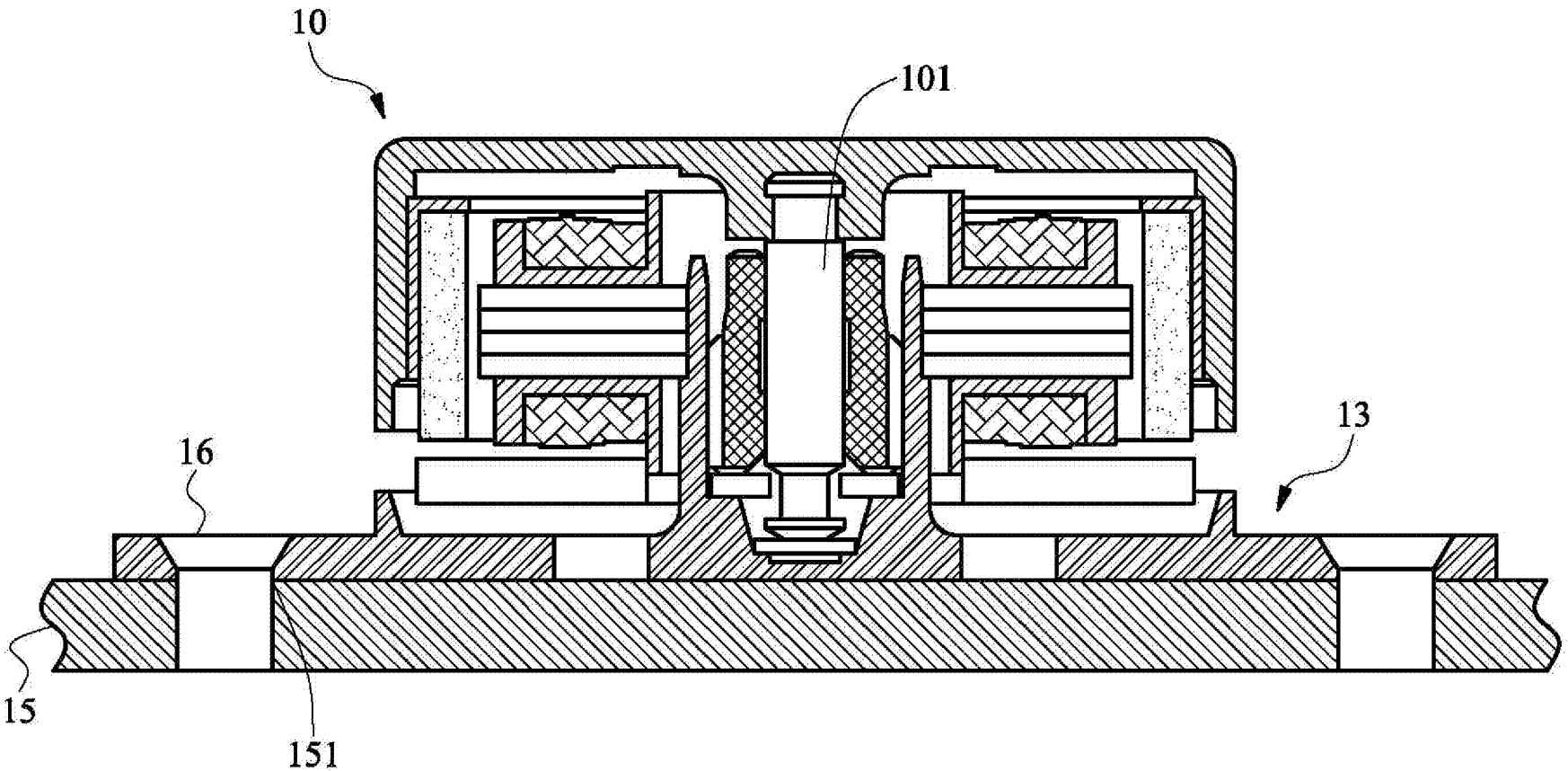
FIG. 1A (PRIOR ART)
FIG. 1A is a sectional assembled view of a conventional cooling fan.
Figure 1B:
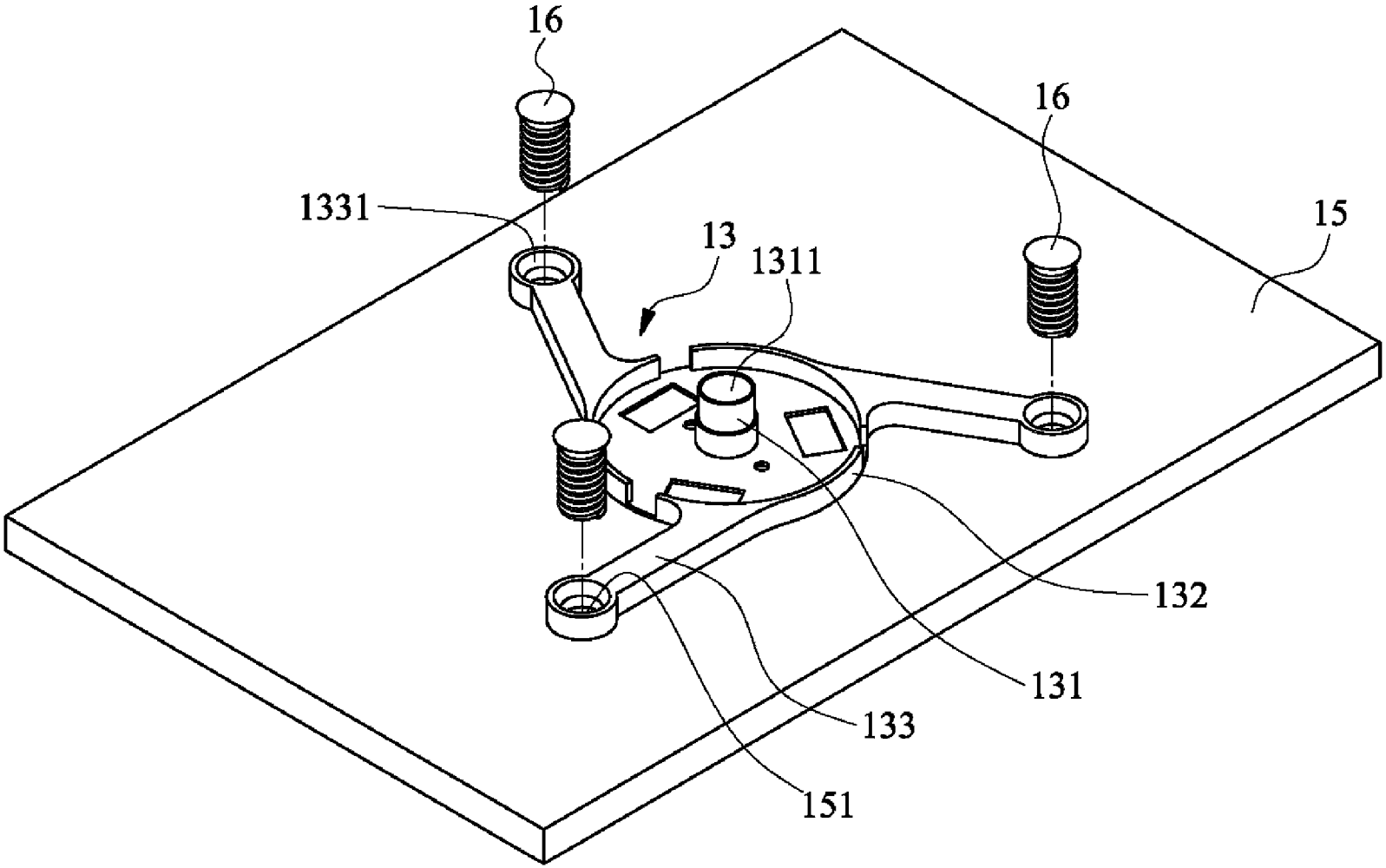
FIG. 1B (PRIOR ART)
FIG. 1B is a perspective view showing the assembly of the shaft seat mount and the heat dissipation board of the conventional cooling fan.
Figure 2:
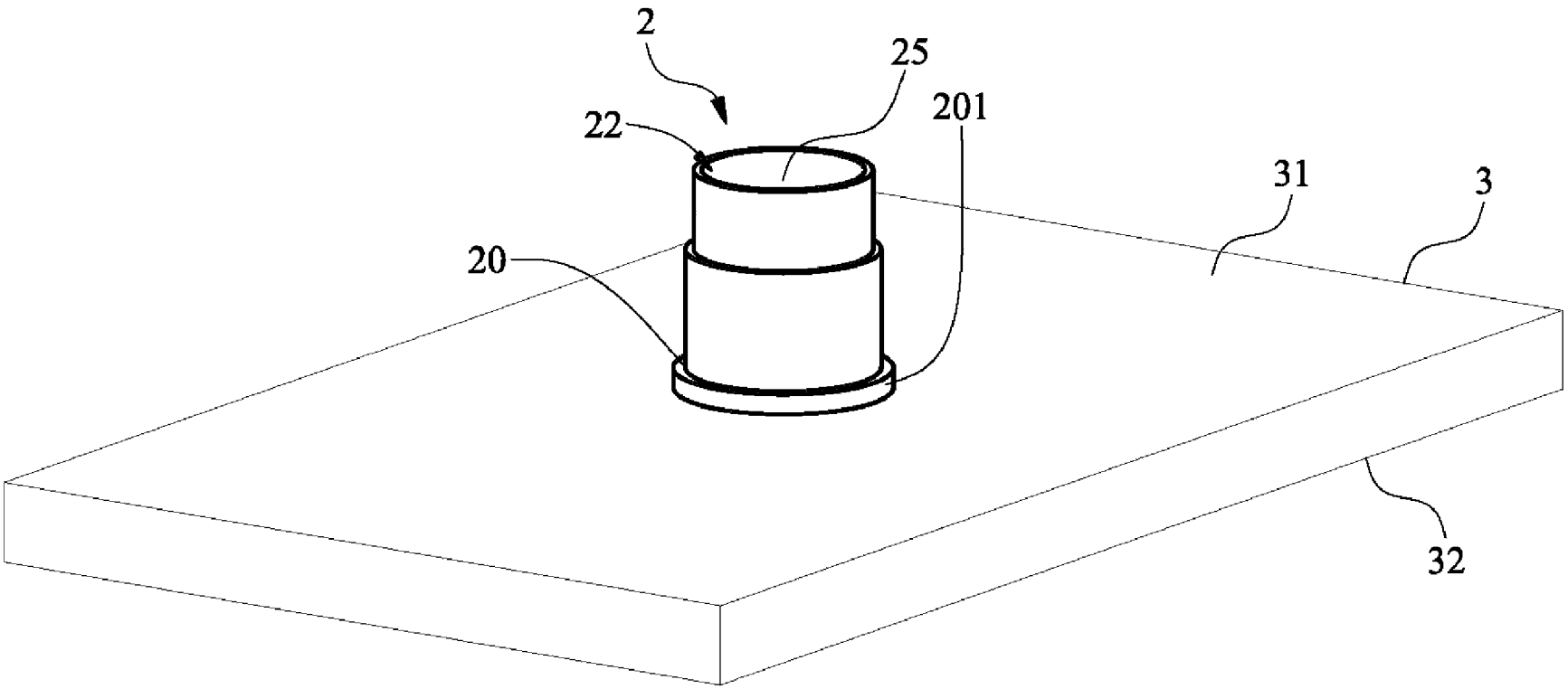
FIG. 2 is a perspective view of the present invention, showing that the shaft bushing and the heat dissipation member of the present invention are integrally connected with each other.
Figure 3:
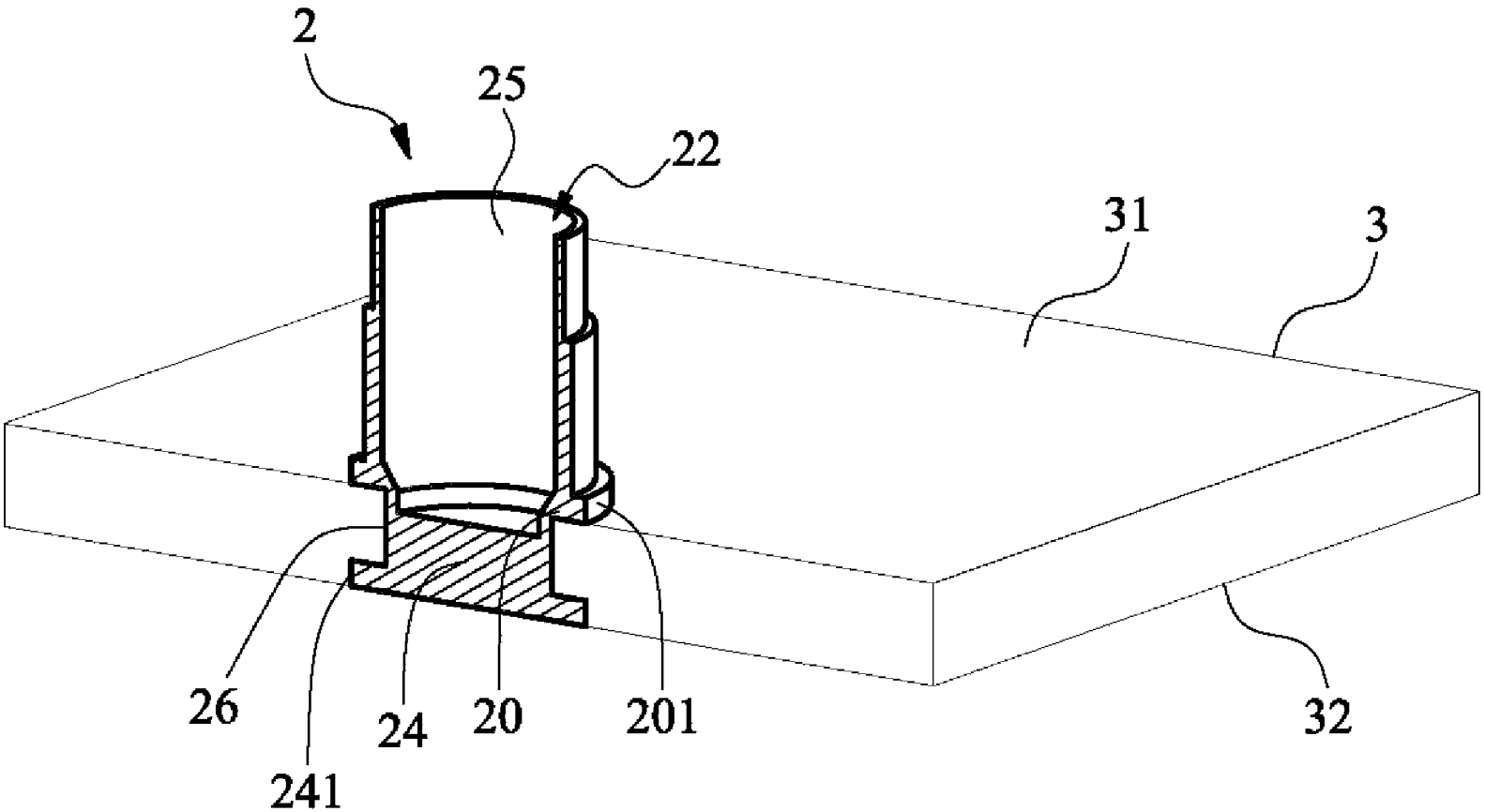
FIG. 3 is a sectional view according to FIG. 2, showing that the shaft bushing and the heat dissipation member of the present invention are integrally connected with each other.
Figure 4:
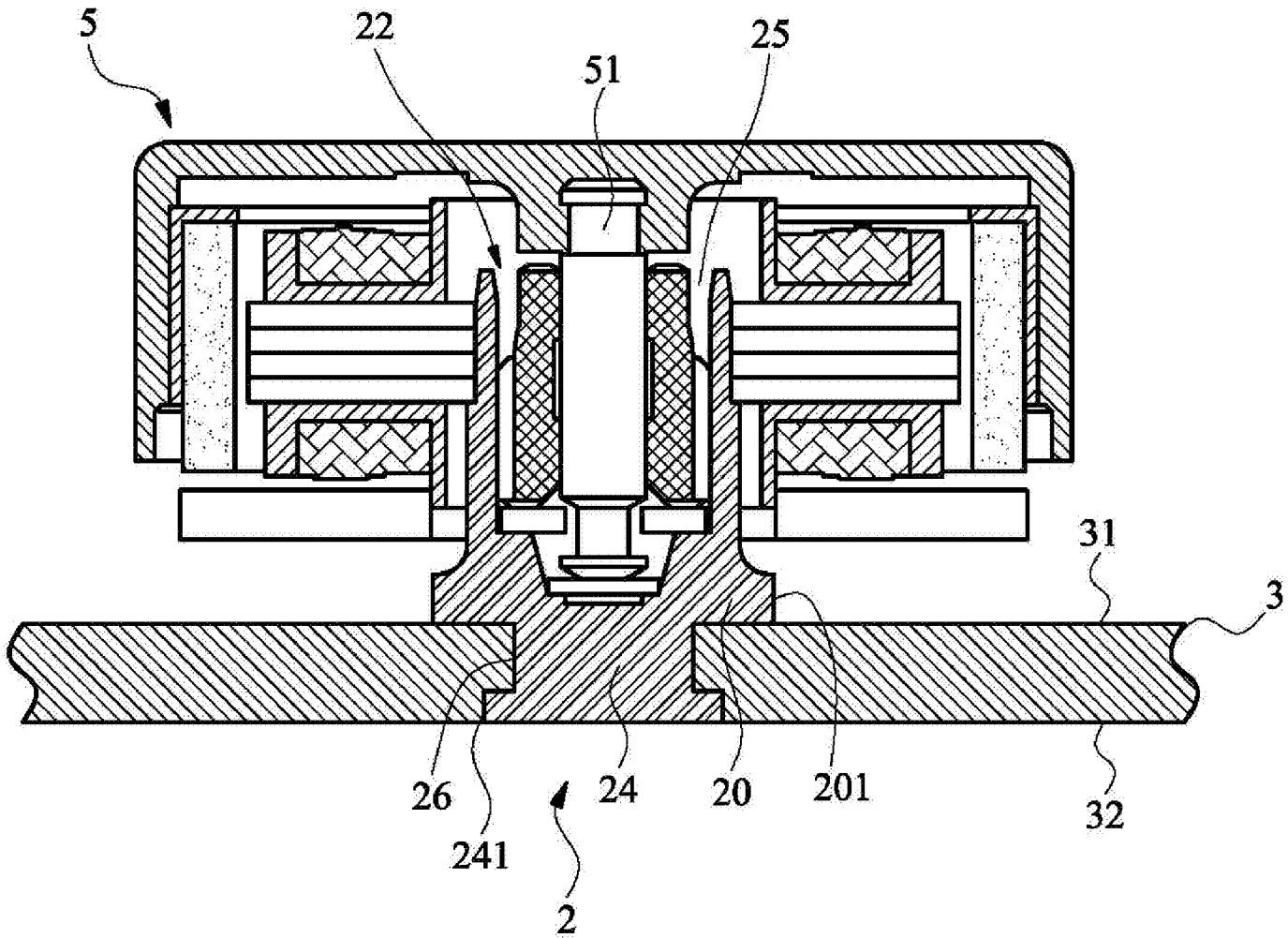
FIG. 4 is a sectional assembled view of the present invention.

Please refer to FIGS. 2, 3 and 4. According to a preferred embodiment, the fan shaft seat structure of the present invention includes a shaft bushing 2 and a heat dissipation member 3. The shaft bushing 2 has a closed end 20, an open end 22 and a connection section 24. A receiving space 25 is defined between the open end 22 and the closed end 20. The connection section 24 extends from the closed end 20 in a direction reverse to the receiving space 25. The heat dissipation member 3 can be a heat dissipation board having a first face 31 and a second face 32. The first face 31 is flush with a first end of the connection section 24 in contact with the closed end 20. The second face 32 is flush with a second end of the connection section 24. The shaft bushing 2 and the heat dissipation member 3 can be integrally formed by means of integral injection molding.

The shaft bushing 2 is made of polymer material or metal material. The heat dissipation member 3 is made of metal material adapted to the material of the shaft bushing 2. In other words, the melting point of the material of the shaft bushing 2 is lower than that of the heat dissipation member 3, whereby the shaft bushing 2 can be integrally connected with the heat dissipation member 3. In this embodiment, the shaft bushing 2 is made of polymer material. However, this is for illustration purposes only and not intended to limit the scope of the present invention.

An outer circumference of the closed end 20 has a flange section 201 extending along the outer circumference of the closed end 20 in contact with the first face 31 of the heat dissipation member 3. The connection section 24 has a protrusion section 241 extending along a circumference of the second end of the connection section 24. The protrusion section 241 is embedded in the heat dissipation member 3. The flange section 201 of the closed end 20 and the protrusion section 241 of the connection section 24 define therebetween a substantially U-shaped or C-shaped groove for accommodating the heat dissipation member 3. The flange section 201 has a diameter larger than that of the protrusion section 241.

Please now refer to FIG. 4. A fan propeller 5 is supported on the shaft bushing 2. The fan propeller 5 has a shaft 51. A first end of the shaft 51 is inserted in the fan propeller 5. A second end of the shaft 51 is received in the receiving space 25 of the shaft bushing 2. When the fan operates at high rotational speed, the fan propeller 5 and the shaft 51 will generate heat spread over the receiving space 25 of the shaft bushing 2. Under such circumstance, the shaft bushing 2 will quickly absorb the heat and transmit the heat to the closed end 20. The closed end 20 then conducts the heat to the connection section 24 and the first face 31 and an interior of the heat dissipation member 3. At the same time, the connection section 24 will further conduct the heat to the protrusion section 241. After absorbing the heat, the protrusion section 241 transfers the heat to the second face 32 and interior of the heat dissipation member 3. The heat absorbed by the first and second faces 31, 32 and the interior of the heat dissipation member 3 will be dissipated at a large heat dissipation area by way of radiation and heat exchange with ambient air. Therefore, the heat dissipation area is increased to enhance heat dissipation effect.

Moreover, when assembling the fan, an operator applies force onto the fan propeller 5 to fit the shaft 51 of the fan propeller 5 into the open end 22 of the shaft bushing 2. The shaft 51 is then further moved to the closed end 20 of the shaft bushing 2 until the shaft 51 of the fan propeller 5 is accommodated in the receiving space 25 of the shaft bushing 2. Accordingly, the fan propeller 5 can be quickly connected with the shaft bushing 2. The shaft bushing 2 is integrally connected with the heat dissipation member 3 so that the shaft bushing 2 will not be deformed or damaged due to any external factor to break the verticality of the shaft bushing 2. Therefore, every shaft bushing 2 has better uniformity. Furthermore, the shaft bushing 2 is integrally connected with the heat dissipation member 3 without using any screw or adhesive. Therefore, the labor and the working time are saved to lower manufacturing cost.

According to the aforesaid, the fan shaft seat structure of the present invention has the following advantages:

1. The present invention has better heat dissipation efficiency.
2. The present invention has larger heat dissipation area.
3. The labor and the working time are saved so that the manufacturing cost is lowered.
4. The present invention can be quickly assembled.
5. The present invention has better uniformity.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A fan shaft seat structure comprising:

a shaft bushing having an open end, a closed end and a connection section, a receiving space being defined between the open end and the closed end, the connection section extending from the closed end in a direction reverse to the receiving space; and a heat dissipation member having a first face and a second face, the first face being flush with a first end of the connection section in contact with the closed end, the second face being flush with a second end of the connection section.

2. The fan shaft seat structure as claimed in claim 1, wherein an outer circumference of the closed end has a flange section extending along the outer circumference of the closed end in contact with the first face of the heat dissipation member.

3. The fan shaft seat structure as claimed in claim 2, wherein the connection section has a protrusion section extending along a circumference of the second end of the connection section, the protrusion section being embedded in the heat dissipation member.

4. The fan shaft seat structure as claimed in claim 3, wherein the flange section of the closed end and the protrusion section of the connection section define. therebetween a groove for accommodating the heat dissipation member, the flange section having a diameter larger than that of the protrusion section.

5. The fan shaft seat structure as claimed in claim 1, wherein a fan propeller is supported on the shaft bushing, the fan propeller having a shaft, a first end of the shaft being inserted in the fan propeller, a second end of the shaft being received in the receiving space of the shaft bushing.

6. The fan shaft seat structure as claimed in claim 1, wherein the heat dissipation member is a heat dissipation board.

7. The fan shaft seat structure as claimed in claim 1, wherein the shaft bushing is made of polymer material or metal material.

8. The fan shaft seat structure as claimed in claim 1, wherein the shaft bushing is integrally connected with the heat dissipation member.

9. The fan shaft seat structure as claimed in claim 2, wherein the shaft bushing is integrally connected with the heat dissipation member.

10. The fan shaft seat structure as claimed in claim 3, wherein the shaft bushing is integrally connected with the heat dissipation member.

11. The fan shaft seat structure as claimed in claim 4, wherein the shaft bushing is integrally connected with the heat dissipation member.

12. The fan shaft seat structure as claimed in claim 5; wherein the shaft bushing is integrally connected with the heat dissipation member.

13. The fan shaft seat structure as claimed in claim 1, wherein the heat dissipation member is made of metal material adapted to the material of the shaft bushing.

* * * * *